US006630039B2

(12) United States Patent
Lukasak et al.

(10) Patent No.: US 6,630,039 B2
(45) Date of Patent: Oct. 7, 2003

(54) EXTRUSION METHOD UTILIZING MAXIMUM EXIT TEMPERATURE FROM THE DIE

(75) Inventors: David A. Lukasak, Tifton, GA (US); David A. King, Valrico, FL (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/784,540

(22) Filed: Feb. 14, 2001

(65) Prior Publication Data

US 2002/0003015 A1 Jan. 10, 2002

Related U.S. Application Data

(60) Provisional application No. 60/184,145, filed on Feb. 22, 2000.

(51) Int. Cl.[7] ..... C22F 1/04
(52) U.S. Cl. ..... 148/690; 148/688; 148/689
(58) Field of Search ..... 148/690, 689, 148/688

(56) References Cited

U.S. PATENT DOCUMENTS

| | | | | | |
|---|---|---|---|---|---|
| 1,926,057 | A | | 9/1933 | Nock et al. | 148/13 |
| 2,249,349 | A | | 7/1941 | Deutsch | 148/11.5 |
| 2,249,353 | A | | 7/1941 | Fritzlen | 148/11.5 |
| 3,113,052 | A | | 12/1963 | Schneck | 148/11.5 |
| 3,222,227 | A | * | 12/1965 | Baugh et al. | 148/415 |
| 3,743,549 | A | * | 7/1973 | Di Russo et al. | 148/693 |
| 3,847,681 | A | | 11/1974 | Waldman et al. | 148/11.5 |
| 3,984,259 | A | * | 10/1976 | Rogers et al. | 148/417 |
| 3,990,922 | A | | 11/1976 | Gullotti et al. | 148/11.5 |
| 4,066,480 | A | | 1/1978 | Gullotti et al. | 148/11.5 |
| 4,092,181 | A | | 5/1978 | Paton et al. | 148/12.7 |
| 4,222,797 | A | | 9/1980 | Hamilton et al. | 148/12.7 |
| 4,295,901 | A | | 10/1981 | Robertson et al. | 148/12.7 |
| 4,358,324 | A | | 11/1982 | Mahoney et al. | 148/12.7 |
| 4,412,870 | A | | 11/1983 | Vernam et al. | 148/2 |
| 4,659,396 | A | | 4/1987 | Lifka et al. | 148/11.5 |
| 4,832,758 | A | | 5/1989 | Brown | 148/12.7 |
| 4,861,389 | A | | 8/1989 | Bryant et al. | 148/3 |
| 4,909,858 | A | | 3/1990 | Reiso | 148/2 |
| 5,223,050 | A | * | 6/1993 | Bryant et al. | 148/415 |
| 5,916,385 | A | * | 6/1999 | Coats et al. | 148/550 |

* cited by examiner

*Primary Examiner*—Roy King
*Assistant Examiner*—Andrew Wessman
(74) *Attorney, Agent, or Firm*—David W. Pearce-Smith; Gary A. Nitowski

(57) ABSTRACT

A method of producing an aluminum base alloy extruded product. The method comprises (a) providing a body of an aluminum base alloy; (b) homogenizing the body at an elevated temperature not exceeding its eutectic temperature for a sufficient period of time to provide a homogeneous distribution of the readily soluble alloy elements, (c) rapidly cooling the body; (d) reheating the body to a reheat temperature of at least 700° F. for a period of at least 0.5 hours; (e) extruding the body from the reheat temperature; (f) solution heat treating the body; and (g) quenching and aging the body.

26 Claims, 8 Drawing Sheets

EXTRUSION METHOD UTILIZING MAXIMUM EXIT TEMPERATURE FROM THE DIE

CROSS REFERENCE TO RELATED APPLICATIONS

This application claims the benefit of U.S. Provisional Application Serial No. 60/184,145, filed Feb. 22, 2000.

TECHNICAL FIELD

This invention relates to methods of extruding materials such as metals. More particularly, the invention relates to methods of extruding aluminum alloys.

BACKGROUND ART

The metal working process known as extrusion involves pressing metal stock (ingot or billet) through a die opening having a predetermined configuration in order to form a shape having indefinite length and a substantially constant cross section. In the extrusion of aluminum alloys with which this invention is particularly concerned, the aluminum stock is preheated to the proper extrusion temperature. It is then placed into a heated cylinder. The cylinder utilized in the extrusion process has a suitable die at one end which has an opening of the desired shape and a reciprocal piston or ram having approximately the same cross-sectional dimensions as the bore of the cylinder. This piston or ram moves against the stock to compress the stock. The opening in the die is the path of least resistance for the billet under pressure, and metal deforms and flows through the die opening to produce a continuous extruded product having the same cross-sectional shape as the die opening.

The extrusion process generates a considerable amount of heat, and as a result, the temperature of the extruded product may vary during the extrusion process. Heat can be a desirable by-product in that the hotter the metal the more deformable the metal becomes. Initially, the die and surrounding parts of the extrusion press act as a heat sink. As the process proceeds, the temperature gap is reduced between the die, and the billet and the die and extrusion press stop acting as a heat sink. Then, the temperatures of the billet and the die both begin to rise. In addition, if the extrusion speed is high, heat may not be dissipated fast enough, and the temperature of the billet rises.

When extruding a series of billets, the temperature of the extrusion product can vary from different billets. In some instances, the rise in temperature may be sufficient to melt or at least weaken the metal to the point at which the frictional stresses at the surface cause cracking. Therefore, after the billet has reached a maximum temperature, the heat begins to become an undesirable by-product of the extrusion process from the standpoint of producing commercial quality extruded product.

The present invention is particularly concerned with hard aluminum base alloys. Extruded profiles of hard aluminum alloys have considerable commercial value. Such alloys find diversified use as structural materials and are used in the aeronautics industry because of their very high strength-to-weight properties. In order to produce extruded articles from such alloys in the most economical manner, the extrusion process should be carried out at the highest extrusion speed possible for the extrusion press being used.

Extrusion pressures, speed and temperature are factors that affect the quality of hard alloys as extruded products. Extrusion speed is usually referred to in terms of the progression of extruded material exiting from the die in linear feet per unit of time (minute or hour) or in terms of the progression of the ram (ram speed) pushing against the metal stock. In order to achieve acceptable surface quality in extruded hard aluminum alloy products, a certain limited range of extrusion speeds and temperatures must be closely observed, with the range being related to the size and complexity of the extrusion, the composition of the alloy and the reduction in cross-sectional area of the metal stock during the extrusion process.

Exceeding the predetermined speed and temperature ranges generally causes a rupture of the extrusion surface and also other defects such as recrystallization, blistering and broken surface, which result in rejection of the extruded product. High strength aluminum alloys must be extruded more slowly and at lower temperatures than lower strength aluminum alloys in order to avoid surface cracking of the high strength alloys with the resulting decrease in productivity. In addition to surface quality, the temperature of the billet must be kept above a certain minimum temperature to avoid phase changes in the crystal structure of the extrusion product which could greatly change the strength characteristics of the final extruded product.

The extrusion conditions (speed and temperature) of hard aluminum alloys are determined empirically and kept below safe speed and temperature limits by experience to reduce the risk of impairing the quality of the extruded product. If these safe limits are set too low, the productivity and thus the profitability of an extrusion plant may be unnecessarily placed in jeopardy. In addition, when operating within the empirically determined safe limits, often there is considerable variation within an extruded piece and from piece to piece for the same shape.

Thus, it can be seen that it would be of great advantage, particularly in high strength aluminum alloys, if the properties of an extruded product and the productivity of an extrusion press can be improved together.

It was against this background that the development of the present invention came about.

The primary object of the present invention is to improve the productivity of an extrusion press.

Another object of the present invention is to improve the productivity of an extrusion press without significantly decreasing the commercial quality of the product that is being extruded. The commercial quality of the extruded product is evaluated in terms of tensile and yield strengths and grain structure.

Yet another object of the present invention is to provide a method and system for extruding high strength aluminum alloys at the highest possible extrusion speeds without loss of extruded product due to physical defects.

Another object of the present invention is to remove the guesswork out of predicting safe extrusion speeds and thus close the gap between the ideal safe speed and the actual operating speed of the extrusion press.

Still another objective of the present invention is to provide a method and apparatus that is capable of increasing productivity in extruding high strength aluminum alloys for a wide variety of shapes and sizes.

These and other objects and advantages of the present invention will be more fully understood and appreciated with reference to the following description.

SUMMARY OF THE INVENTION

In accordance with the present invention, there is disclosed a method of producing an aluminum base alloy extruded product. The method comprising: (a) providing a body of an aluminum base alloy; (b) homogenizing the body at an elevated temperature not exceeding its eutectic temperature for a sufficient period of time to provide a homogeneous distribution of the readily soluble alloy elements, (c) rapidly cooling the body; (d) reheating the body to a reheat temperature of at least 700° F. for a period of at least 0.5 hours, (e) extruding the body from the reheat temperature; (f) solution heat treating the body; and (g) quenching and aging the body.

A second embodiment of the invention is a method of extruding an aluminum base alloy extruded product comprising: (a) providing a body of an aluminum base alloy; (b) homogenizing the body at an elevated temperature not exceeding its eutectic temperature for a sufficient period of time to provide a homogeneous distribution of the readily soluble alloy elements, (c) rapidly cooling the body to a reheat temperature of about 700° to about 860° F.; (d) maintaining the body at the reheat temperature for at least 0.5 hours; (e) extruding the body from the reheat temperature; (f) solution heat treating the body; and (g) quenching and aging the body.

BRIEF DESCRIPTION OF THE DRAWINGS

Other features of the present invention will be further described or rendered obvious in the following related description of the preferred embodiment that is to be considered together with the accompanying drawings wherein like figures refer to like parts and further wherein.

DEFINITIONS

Figure 1:
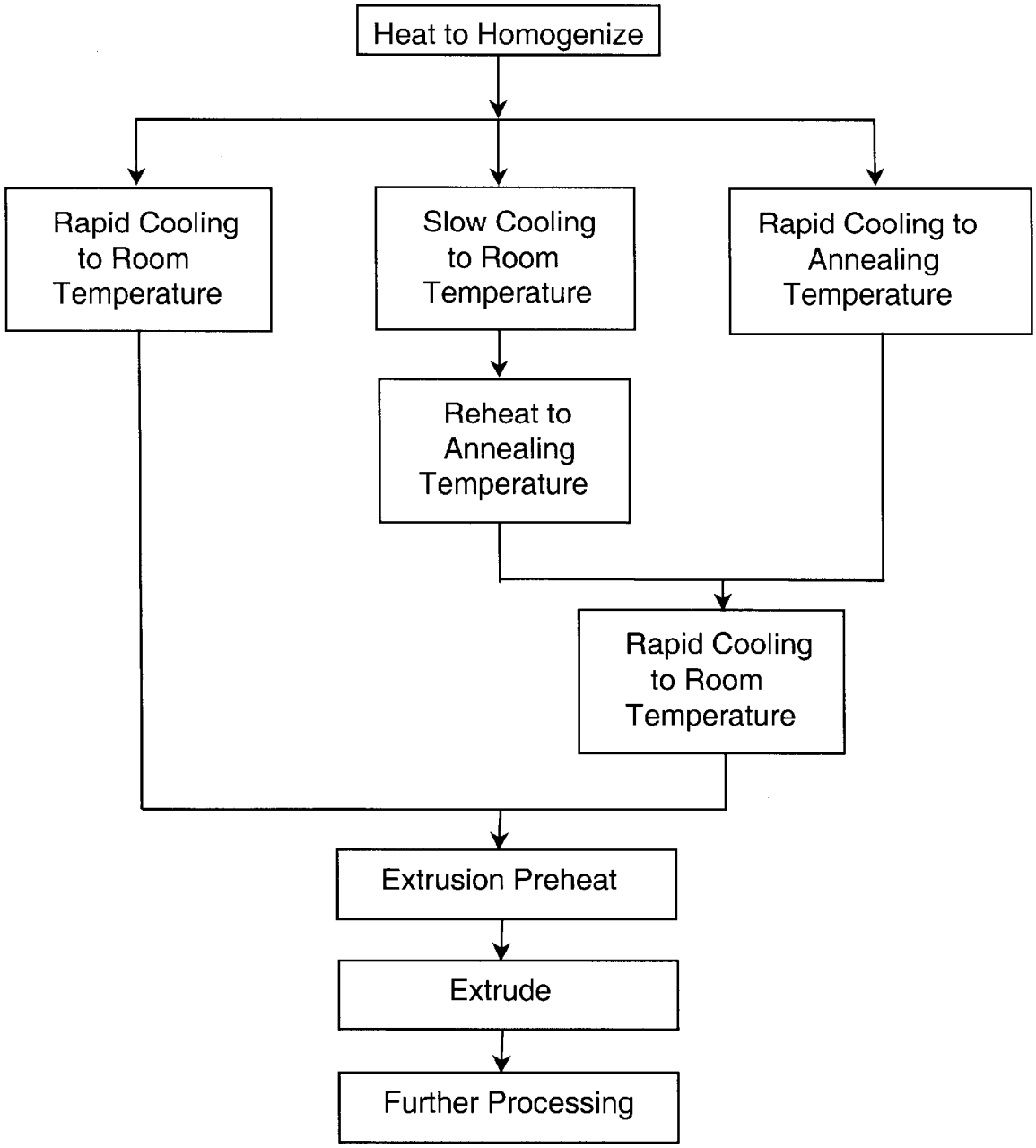
FIG. 1 is a flow diagram illustrating variations in a method for thermally pretreating an aluminum alloy according to the invention.

The term "2XXX" or "2000 Series", when referring to alloys, shall mean structural aluminum alloys containing copper as their main alloying element, or the ingredient present in largest quantity. These are alloys that either are or would be classified by the Aluminum Association with an alloy designation that begins with the number 2.

The term "5XXX" or "5000 Series", when referring to alloys, shall mean structural aluminum alloys containing magnesium as their main alloying element, or the ingredient present in largest quantity. These are alloys that either are or would be classified by the Aluminum Association with an alloy designation that begins with the number 5.

The term "7XXX" or "7000 Series", when referring to alloys, shall mean structural aluminum alloys containing zinc as their main alloying element, or the ingredient present in largest quantity. These are alloys that either are or would be classified by the Aluminum Association with an alloy designation that begins with the number 7.

The term "7X50" shall mean any alloy currently or subsequently registered in this family or subgroup of 7XXX alloys. The term expressly includes, but shall not be limited to, 7050 aluminum and substantially identical 7150 aluminum.

The term "7X5X" shall mean any alloy currently or subsequently registered in this family or subgroup of 7XXX alloys. The term expressly includes, but shall not be limited to, 7050 aluminum and 7055 aluminum.

The term "bar" is used herein to refer to metal that has been formed into a solid product that is long in relation to its cross section, which is square, rectangular, a regular hexagon, or octagon, and whose perpendicular distance between parallel faces is 0.375 inches or greater.

The terms "broken surface", "tearing", "surface checking" and "chatter cracks" are interchangeable terms used in the art to refer to surface defects that form a pattern of fine transverse cracks resulting from longitudinal tensile stresses that are high compared with the strength of the alloy at its working temperature. Tearing is a limiting factor for extrusion of hard aluminum alloys and is caused when the predetermined speed and temperature range for an alloy are exceeded. The cracks are unacceptable for commercial product from the standpoints of surface appearance, finishing ability, dimensional accuracy and mechanical integrity of the extruded product.

The term "foil" is used herein to refer to metal that has been formed into a layer having a thickness of less than about 0.15 mm (0.006 inch). Foil is commonly a rolled product having a rectangular cross section.

The terms "hard alloy" and "high strength aluminum alloys" are used interchangeably herein to refer to aluminum alloys that contain alloying elements which following a solution heat treatment provide high strength suitable for aircraft applications. In addition, hard alloys require a solution heat treatment after working to develop their properties. Examples of hard alloys include 2000 series, 5000 series and 7000 series alloys of the Aluminum Association classification system. These alloy series are also referred to in the art as 2XXX, 5XXX and 7XXX alloys.

The term "homogenize" is used herein to refer to a high temperature soaking treatment where a substantial portion of the soluble constituents of the alloy have been dissolved. This operation causes undissolved particles of the soluble elements located at the grain boundary and in the eutectic network to go into solid solution. It is usually accompanied by a virtual disappearance of an as-cast cored dendritic structure.

The term "plate" is used herein to refer to metal that has been formed into a layer having a thickness greater than about 6.325 mm (0.249 inches). Plate is commonly a rolled product having a rectangular cross section.

The term "rod" is used herein to refer to metal that has been formed into a solid product that is long in relation to its cross-sectional dimensions and has a cross section other than that of sheet, plate, bar, tube or wire.

The term "sheet" is used herein to refer to metal that has been formed into a layer having a thickness greater than about 0.15 mm (0.006 inch) and less than about 6.325 mm (0.249 inch). Sheet is commonly a rolled product having a rectangular cross section.

The term "wire" is used herein to refer to metal that has been formed into a solid product that is long in relation to its cross section. The cross section is square or rectangular with sharp or rounded corners or edges, or is round, a regular hexagon, or regular octagon, and whose diameter or greatest perpendicular distance between parallel faces is less than 9.525 mm (0.375 inch).

MODE FOR CARRYING OUT THE INVENTION

The hard aluminum alloys have been found difficult to hot work in commercial production. Extrusion conditions (speed and temperature) of hard aluminum alloys are kept below a safe limit by experience to reduce the risk of sacrificing the desired properties, and as a result, productivity and profitability of an extrusion press are less than optimal.

Typically, the preheat temperature is changed only if unacceptable extruded product is produced. Often the cracks associated with tearing may be no deeper than 0.001 to 0.005 inch and cannot be detected until after the extruded product has been anodized. Since the cracks grow larger as the extrusion speed is increased and disappear as the extrusion speed is decreased, the extrusion process is frequently performed well below an empirically determined maximum extrusion speed to insure that only commercially acceptable product is produced.

The present invention is a method for increasing the productivity and profitability of an extrusion press without sacrificing the commercial quality of the product. As will be described in greater detail below, the present invention includes: providing a body of an aluminum base alloy; homogenizing the body at an elevated temperature not exceeding its eutectic temperature for a sufficient period of time to provide a homogeneous distribution of the readily soluble alloy elements; rapidly cooling the body to a reheat temperature of about 700° F. to about 860° F.; maintaining the body at the reheat temperature for at least 0.5 hours; extruding the body from the reheat temperature; solution heat treating the body; and quenching and aging the body.

The stock normally used for the production of extruded aluminum base alloy articles is in the form of ingots or cast billets. The ingots may be produced by any of the well known casting processes in the art, the continuous or semi-continuous method being the most commonly used at present. Because the ingot is cast, there is a certain amount of inhomogeneity in the structure, and the ingot is homogenized. The homogenization treatment is at a temperature of from 842° to 1050° F. (450° to 565.5° C.), preferably from 842° to 950° F. (450° to 510° C.), for from 10 to 24 hours, preferably at least 15 hours. The process of the present invention is particularly appropriate for alloys such as AA 7075 which have deliberate additions of elements with limited solubility so that the homogenization treatment of the present invention drives these additions out of the solution.

Following the homogenization step, the alloys are cooled according to desired rate one of several practices.

Practice 1

Figure 2:
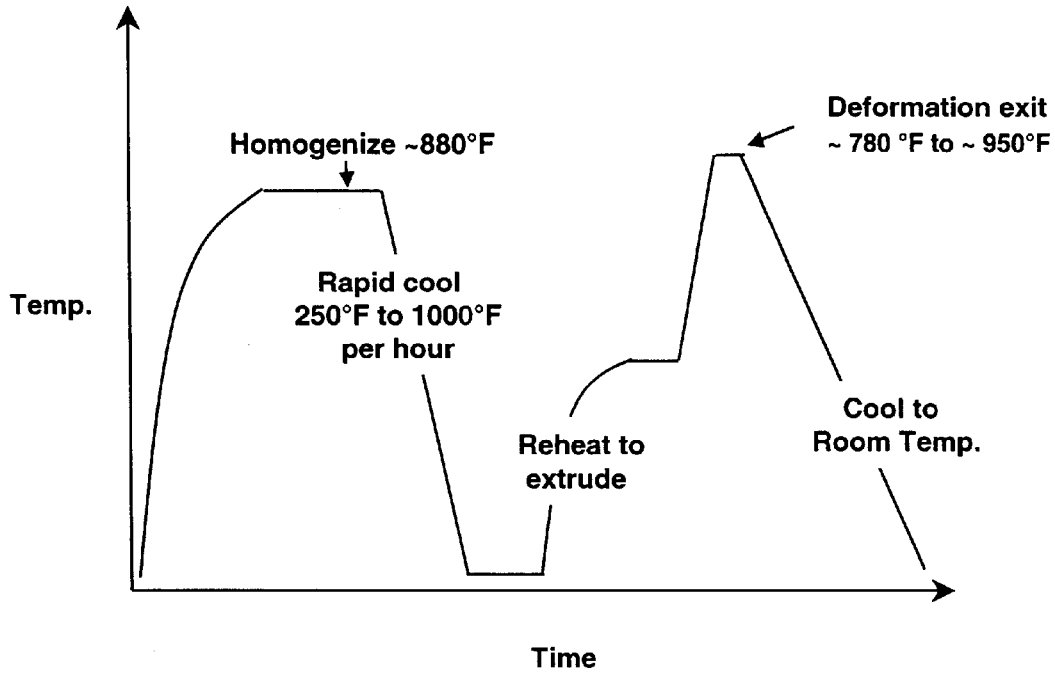
FIG. 2 is a is a time-temperature bar graph illustrating a preferred first embodiment of the invention.

As shown in FIG. 2, a rapid cooling from homogenization to room temperature can be used to practice the present invention. By rapid cooling, it is meant cooling at a rate of between about 250° F. and about 1000° F. per hour. Rapid cooling can be accomplished using forced air cooling, water cooling, or mist cooling.

After cooling the homogenized alloy to substantially room temperature, the material is reheated in a furnace to an elevated temperature called the preheat temperature, also know as the reheat temperature. Induction heating and gas fired heating are preferred reheating practices. The preheat temperature is between about 500° F. and about 750° F. Those skilled in the art will acknowledge that the preheat temperature is generally the same for each billet that is to be extruded in a series of billets and is based on experience.

The preheat temperature represents the best guess starting point for extruding the billet into the desired configuration without producing commercially unacceptable product. The selection of a preheat temperature can have a major impact on the productivity and thus the profitability an extrusion press. Preheating the billet to too low a temperature results in slower extrusion rates and less metal being extruded per unit time. Preheating the billet to too high a temperature results in tearing and the production of unacceptable product. Typically, the preheat temperature is set lower than necessary to insure that only commercially acceptable product is extruded.

After the material has soaked at the preheat temperature, it is ready to be placed in the extrusion press and extruded. In an effort to avoid unnecessary cooling of the billet, care is taken to minimize the time it takes to transport the material from the preheat furnace to the extrusion press. The billet is placed into a preheated compartment or container in the extrusion press.

During the extrusion process a considerable amount of heat is generated, and as a result, the temperature of the extruded product exiting the extrusion die is hotter than the preheat temperature. After exiting the die the extruded product is cooled to room temperature.

As depicted in FIG. 1, the extruded product can undergo further processing. Further processing steps may include, but are not limited to, solution heat treating, quenching, aging, cold working, stretching, and drawing, and artificial aging. It is recognized that the combination of any of these post-extrusion further processing steps, in any order that would be reasonable to one skilled in the art, is anticipated by and incorporated into the instant invention.

A preferred method of drawing is such that the cross-section of the extruded product is reduced by 3%. In one embodiment of this invention, the extruded product is cold worked by means know to those skilled in the art, so that the imparted cold working effect is equivalent to the effect that occurs by stretching the extruded product at room temperature to less than about 10%. In another preferred embodiment of this invention, the extruded product is cold worked, so that the imparted cold working effect is equivalent to the effect that occurs by stretching the extruded product at room temperature to at least 3%. In still another preferred embodiment of this invention, the extruded product is cold worked, so that the imparted cold working effect is equivalent to the effect that occurs by stretching the extruded product at room temperature to at least 1%.

Practice 2

Figure 3:
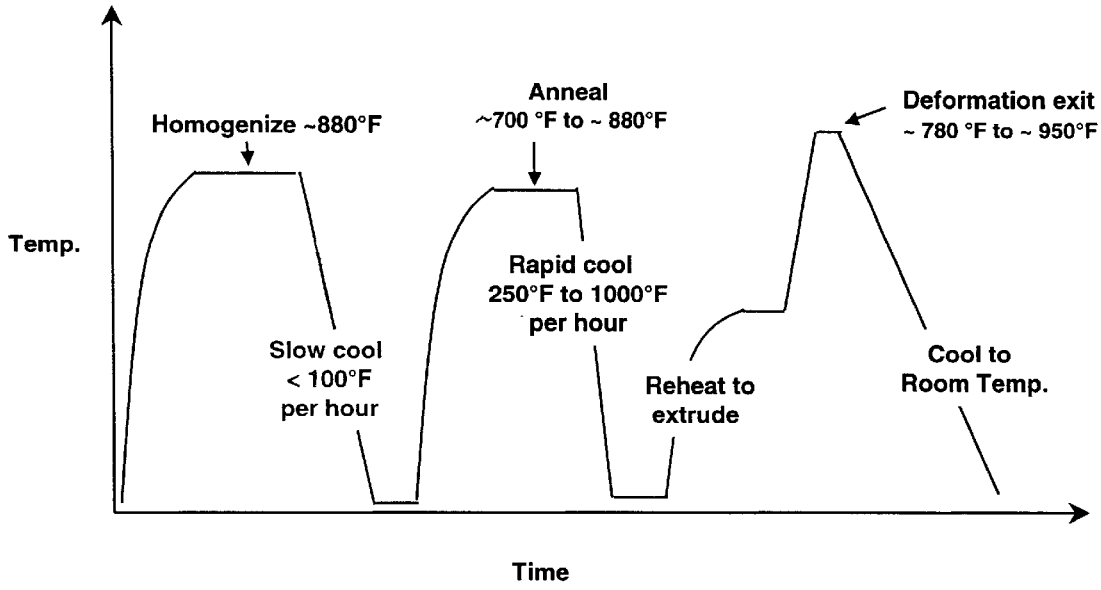
FIG. 3 is a is a time-temperature bar graph illustrating a preferred second embodiment of the invention.

In a second practice shown in FIG. 3, a slow cooling from homogenization to room temperature can be used to practice the present invention. By slow cooling, it is meant cooling at a rate of less than about 100° F. per hour. This cooling to room temperature is preferably air cooling.

After cooling the homogenized alloy to substantially room temperature, the material is reheated in a furnace to an elevated temperature called the annealing temperature. The annealing temperature is between about 700° F. and about 880° F. The material is held at this temperature and then rapidly cooled to room temperature. By rapid cooling, it is meant cooling at a rate of between about 250° F. and about 1000° F. per hour. Rapid cooling can be accomplished using forced air cooling, water cooling, or mist cooling.

After cooling the annealed alloy to substantially room temperature, the material is reheated in a furnace to an elevated temperature called the preheat temperature, also know as the reheat temperature. Induction heating and gas fired heating are preferred reheating practices. The preheat temperature is between about 500° F. and about 750° F. Those skilled in the art will acknowledge that the preheat temperature is generally the same for each billet that is to be extruded in a series of billets and is based on experience.

The preheat temperature represents the best guess starting point for extruding the billet into the desired configuration without producing commercially unacceptable product. The selection of a preheat temperature can have a major impact on the productivity and thus the profitability an extrusion press. Preheating the billet to too low a temperature results in slower extrusion rates and less metal being extruded per unit time. Preheating the billet to too high a temperature results in tearing and the production of unacceptable product. Typically, the preheat temperature is set lower than necessary to insure that only commercially acceptable product is extruded.

After the material has soaked at the preheat temperature, it is ready to be placed in the extrusion press and extruded. In an effort to avoid unnecessary cooling of the billet, care is taken to minimize the time it takes to transport the material from the preheat furnace to the extrusion press. The billet is placed into a preheated compartment or container in the extrusion press.

During the extrusion process a considerable amount of heat is generated, and as a result, the temperature of the extruded product exiting the extrusion die is hotter than the preheat temperature. After exiting the die the extruded product is cooled to room temperature.

As depicted in FIG. 1, the extruded product can undergo further processing. Further processing steps may include, but are not limited to, solution heat treating, quenching, aging, cold working, stretching, and drawing, and artificial aging. It is recognized that the combination of any of these post-extrusion further processing steps, in any order that would be reasonable to one skilled in the art, is anticipated by and incorporated into the instant invention.

A preferred method of drawing is such that the cross-section of the extruded product is reduced by 3%. In one embodiment of this invention, the extruded product is cold worked by means know to those skilled in the art, so that the imparted cold working effect is equivalent to the effect that occurs by stretching the extruded product at room temperature to less than about 10%. In another preferred embodiment of this invention, the extruded product is cold worked, so that the imparted cold working effect is equivalent to the effect that occurs by stretching the extruded product at room temperature to at least 3%. In still another preferred embodiment of this invention, the extruded product is cold worked, so that the imparted cold working effect is equivalent to the effect that occurs by stretching the extruded product at room temperature to at least 1%.

Practice 3

Figure 4:
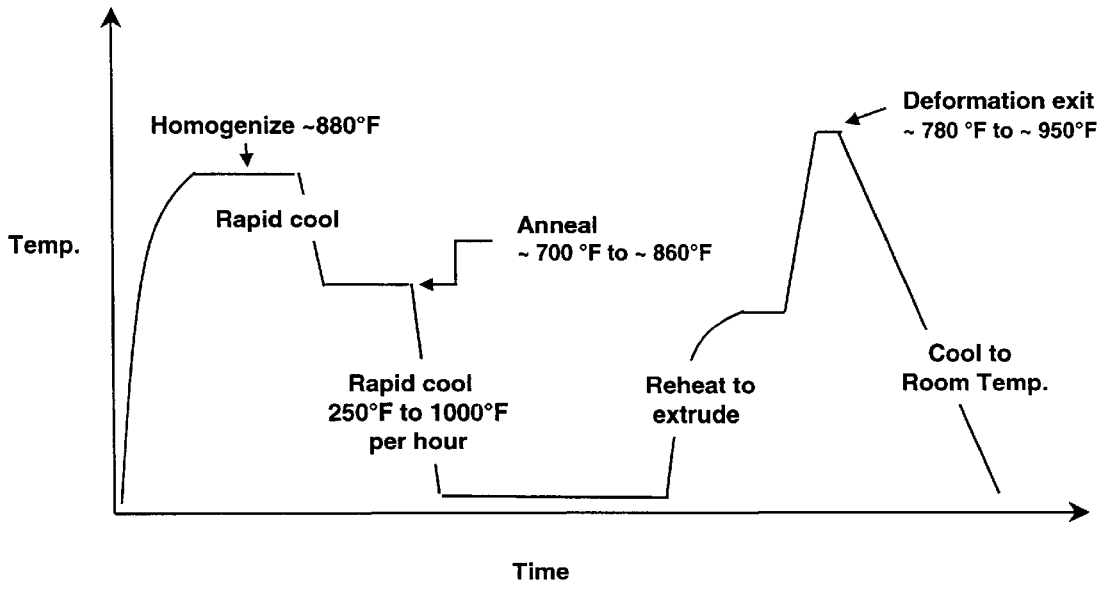
FIG. 4 is a is a time-temperature bar graph illustrating a preferred third embodiment of the invention.

As shown in FIG. 4, a rapid cooling from homogenization to an annealing temperature is used to practice the present invention. In this embodiment of the present invention, the material is not cooled to room temperature prior to annealing. The annealing temperature is between about 700° F. and about 880° F. By rapid cooling, it is meant cooling at a rate of between about 250° F. and about 1000° F. per hour. Rapid cooling can be accomplished using forced air cooling, water cooling, or mist cooling.

After cooling the homogenized alloy to substantially annealing temperature, the material is soaked at that temperature and then rapidly cooled to room temperature. By rapid cooling, it is meant cooling at a rate of between about 250° F. and about 1000° F. per hour. Rapid cooling can be accomplished using forced air cooling, water cooling, or mist cooling.

After cooling the homogenized alloy to substantially room temperature, the material is reheated in a furnace to an elevated temperature called the preheat temperature, also know as the reheat temperature. Induction heating and gas fired heating are preferred reheating practices. The preheat temperature is between about 500° F. and about 750° F. Those skilled in the art will acknowledge that the preheat temperature is generally the same for each billet that is to be extruded in a series of billets and is based on experience.

The preheat temperature represents the best guess starting point for extruding the billet into the desired configuration without producing commercially unacceptable product. The selection of a preheat temperature can have a major impact on the productivity and thus the profitability an extrusion press. Preheating the billet to too low a temperature results in slower extrusion rates and less metal being extruded per unit time. Preheating the billet to too high a temperature results in tearing and the production of unacceptable product. Typically, the preheat temperature is set lower than necessary to insure that only commercially acceptable product is extruded.

After the material has soaked at the preheat temperature, it is ready to be placed in the extrusion press and extruded. In an effort to avoid unnecessary cooling of the billet, care is taken to minimize the time it takes to transport the material from the preheat furnace to the extrusion press. The billet is placed into a preheated compartment or container in the extrusion press.

During the extrusion process a considerable amount of heat is generated, and as a result, the temperature of the extruded product exiting the extrusion die is hotter than the preheat temperature. After exiting the die the extruded product is cooled to room temperature.

As depicted in FIG. 1, the extruded product can undergo further processing. Further processing steps may include, but are not limited to, solution heat treating, quenching, aging, cold working, stretching, and drawing, and artificial aging. It is recognized that the combination of any of these post-extrusion further processing steps, in any order that would be reasonable to one skilled in the art, is anticipated by and incorporated into the instant invention.

A preferred method of drawing is such that the cross-section of the extruded product is reduced by 3%. In one embodiment of this invention, the extruded product is cold worked by means know to those skilled in the art, so that the imparted cold working effect is equivalent to the effect that occurs by stretching the extruded product at room temperature to less than about 10%. In another preferred embodiment of this invention, the extruded product is cold worked, so that the imparted cold working effect is equivalent to the effect that occurs by stretching the extruded product at room temperature to at least 3%. In still another preferred embodiment of this invention, the extruded product is cold worked, so that the imparted cold working effect is equivalent to the effect that occurs by stretching the extruded product at room temperature to at least 1%.

The following examples illustrate the preferred method of practicing the present invention and the advantage of the present invention over the prior art.

EXAMPLES

All of the Examples below use aluminum alloy 7075 which is cast in a conventional manner. Billets were made from the cast alloy. The billets were homogenized by heating the billets to about 880° F. and preheated to 700° F. (371° C.) prior to extrusion a direct extrusion. This is the standard control practice listed in Table 1 below and it is the common portion of the three practices described above.

TABLE 1

| Condition | ID | Thermal Treatment |
|---|---|---|
| 1 | Std. | Standard preheat without anneal (standard control) |
| 2 | Std. Over. | Standard + 700° F. anneal overnight |
| 3 | 700A | Standard + 700° F. anneal for 4 hours and air cooled to room temperature + reheated to 700° F. |
| 4 | 775A | Standard + 775° F. anneal for 2 hours and then air cooled to room temperature + reheated to 700° F. |
| 5 | 825A | Standard + 825° F. anneal for 2 hours and air cooled to room temperature + reheated to 700° F. extruded |

Figure 5:
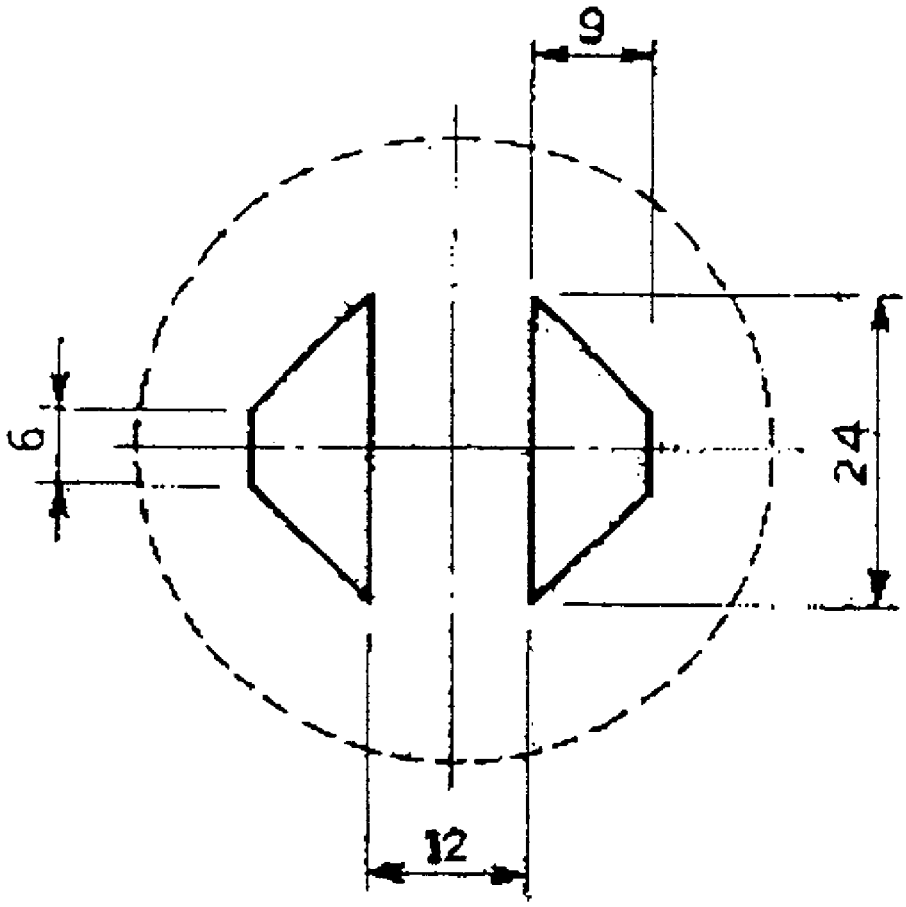
FIG. 5 is a cross-sectional view of the die configuration used in the Examples.

The die configuration used in the following Examples is shown in FIG. 5. This configuration is not critical to practicing the invention. It was chosen because it results in extruded sections having extremely sharp corners which would increase the likelihood of tearing during extrusion. The sharpness of the corners in this section exceeds the sharpness found in most aerospace extrusions.

Examples 1–4 (Prior Art)

In Examples 1–4, there is no anneal after homogenization. The target exit temperature differed in Examples 1–4. The target exit temperature for Example 1 was 820° F. (438° C.), for Example 2 it was 830° F. (443° C.), for Example 3 it was 850° F. (454° C.) and for Example 4 it was 880° F. (471° C.). The billets were extruded and the breakout pressure, maximum exit target temperature, the ram speed were recorded on Table 2 below.

In Example 1, the temperature slowly increased throughout the run. The peak ram speed was 29 inches per minute (ipm). The resulting quality of the product was determined to be acceptable until the exit temperature rose to about 835° F. (446° C.) at which point tearing began. This example demonstrates the condition of the prior art. Simply controlling the exit temperature produces good product but does not necessarily produce good product at the best levels of productivity.

In Example 2, the temperature slowly increased throughout the run. The peak ram speed was 49 inches per minute (ipm). The resulting quality of the product was determined to be acceptable until the exit temperature rose to about 835° F. (446° C.) at which point tearing began. This example demonstrates the condition of the prior art. Simply controlling the exit temperature produces good product but does not necessarily produce good product at the best levels of productivity.

In Examples 3 and 4, the temperature slowly the peak ram speed was 85 and 78 inches per minute (ipm). The resulting quality of the product was determined to be acceptable until the exit temperature rose to about 800° F. at which point tearing began. This example demonstrates the condition of the prior art. Simply controlling the ram speed exit produces best levels of productivity temperature not good product.

TABLE 2

| Example | Billet ID | Breakout Pressure (psi) | Target Exit Temp (° F.) | Max. Exit Temp (° F.) | Max. Speed (ipm) | Surface Condition Comments |
|---|---|---|---|---|---|---|
| 1 | Std. | 6000 | 820 | 840 | 29 | Very slow breakthrough and slow temperature increase. Tore at 835° F. |
| 2 | Std. | 6100 | 830 | 830 | 49 | Heavy broken surface at beginning of extrusion |
| 3 | Std. | 6100 | 850 | 854 | 85 | Broken surface at 800° F. |
| 4 | Std. | 6100 | 880 | 840 | 78 | Broken surface at 802° F. |

Examples 5–7

In Examples 5–7, the material was annealed after homogenization at about 700° F. The target exit temperature differed in Examples 5–7. The target exit temperature for Examples 5 and 6 was 820° F. (438° C.) and for Example 7 it was 880° F. (471° C.). The billets were extruded and the breakout pressure, maximum exit target temperature, the ram speed were recorded on Table 3 below.

Surprisingly, there was only slight tearing in Examples 5 and 6, which were extruded at ram speeds similar to Example 2. These Examples demonstrates that the anneal of the present invention can be used to increase the productivity of the extrusion press.

TABLE 3

| Example | Billet ID | Breakout Pressure (psi) | Target Exit Temp (° F.) | Max. Exit Temp (° F.) | Max. Speed (ipm) | Surface Condition Comments |
|---|---|---|---|---|---|---|
| 5 | 700A | 5500 | 820 | 841 | 49 | Light tearing at end of extrusion |
| 6 | 700A | 5800 | 820 | 828 | 48 | Light tearing at end of extrusion |
| 7 | 700A | 6100 | 880 | 830 | 78 | Broken surface at 810 F. |

Examples 8–11

In Examples 8–11, the material was annealed after homogenization at about 725° F. The target exit temperature differed in Examples 8–11. The target exit temperature for Examples 8 and 9 was 850° F. and for Examples 10 and 11 it was 880° F. (471° C.). The billets were extruded and the breakout pressure, maximum exit target temperature, the ram speed were recorded on Table 4 below.

Unexpectedly, the higher annealing temperature (725° F.) resulted in better product at higher ram speeds. These Examples demonstrates that the anneal of the present invention can be used to increase the productivity of the extrusion press.

TABLE 4

| Example | Billet ID | Breakout Pressure (psi) | Target Exit Temp (° F.) | Max. Exit Temp (° F.) | Max. Speed (ipm) | Surface Condition Comments |
|---|---|---|---|---|---|---|
| 8 | 775A | 6100 | 850 | 848 | 40 | Bolster rub. No hot tearing |
| 9 | 775A | 6000 | 850 | 868 | 71 | Light tearing at end of extrusion |
| 10 | 775A | 6100 | 880 | 885 | 57 | Light tearing at 876 F., recovered at 880 F. |
| 11 | 775A | 5900 | 880 | 898 | 62 | Light broken surface started at 880 F. |

Examples 12–15

In Examples 12–15, the material was annealed after homogenization at about 820° F. The target exit temperature differed in Examples 12–15. The target exit temperature for Examples 12 and 13 was 850° F. and for Examples 14 and 15 it was 880° F. (471° C.). The billets were extruded and the breakout pressure, maximum exit target temperature, the ram speed were recorded on Table 5 below.

Surprisingly, the higher annealing temperature (820° F.) resulted in even better product at higher ram speeds than those annealed at 725° F. These Examples demonstrate that the anneal of the present invention can be used to increase the productivity of the extrusion press.

TABLE 5

| Example | Billet ID | Breakout Pressure (psi) | Target Exit Temp (° F.) | Max. Exit Temp (° F.) | Max. Speed (ipm) | Surface Condition Comments |
|---|---|---|---|---|---|---|
| 12 | 820A | 6100 | 850 | 861 | 40 | Bolster rub. No hot tears. |
| 13 | 820A | 6000 | 850 | 861 | 74 | Light tearing at end of extrusion |
| 14 | 820A | 6000 | 880 | 894 | 54 | Light tearing at 880° F. |
| 15 | 820A | 6100 | 880 | 892 | 59 | Light tearing at 880° F. |
| 16 | Std. Over | 6000 | 850 | 861 | 78 | Very ugly tearing at 805° F. |

Annealing the billet at 820° F. and 775° F. has a dramatic influence on the exit temperature in which hot tearing occurs. Without an anneal, the metal tears at around 800° F. exit temperature while annealing raises the exit temperature to above 850° F. without tearing. Extruding at higher temperatures allows for the metal to be extruded faster and thus the extrusion presses become more efficient.

Figure 6:
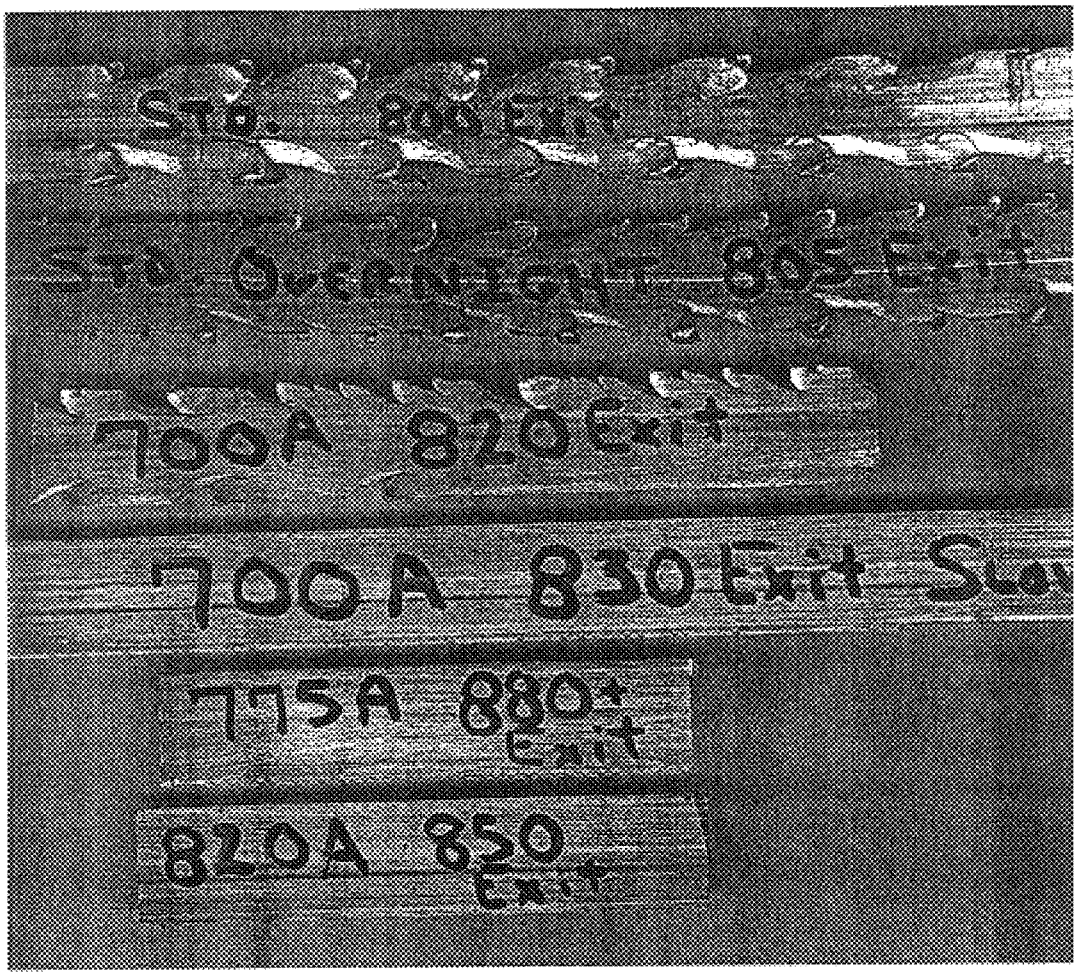
FIG. 6 is photograph showing the surface tearing of billet under several different conditions.

In addition, the appearance of the tearing changes significantly. FIG. 6 shows the surface condition for several of the extrusions. As can be seen in FIG. 6, the tearing of extrusions from standard billet have the most severe tears. Annealing billet at 700° F. help decreased the severity somewhat, but annealing at 775° F. has very dramatic affect.

Figure 8:
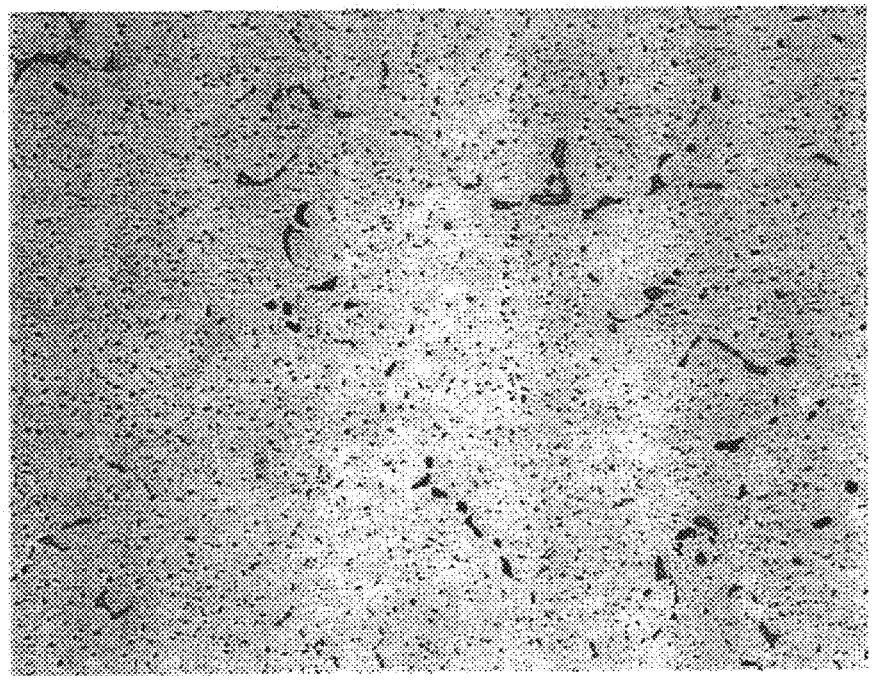
FIG. 8 is photomicrograph showing the microstructure of billet annealed for 4 hours at 700° F. at 400× magnification.
Figure 9:
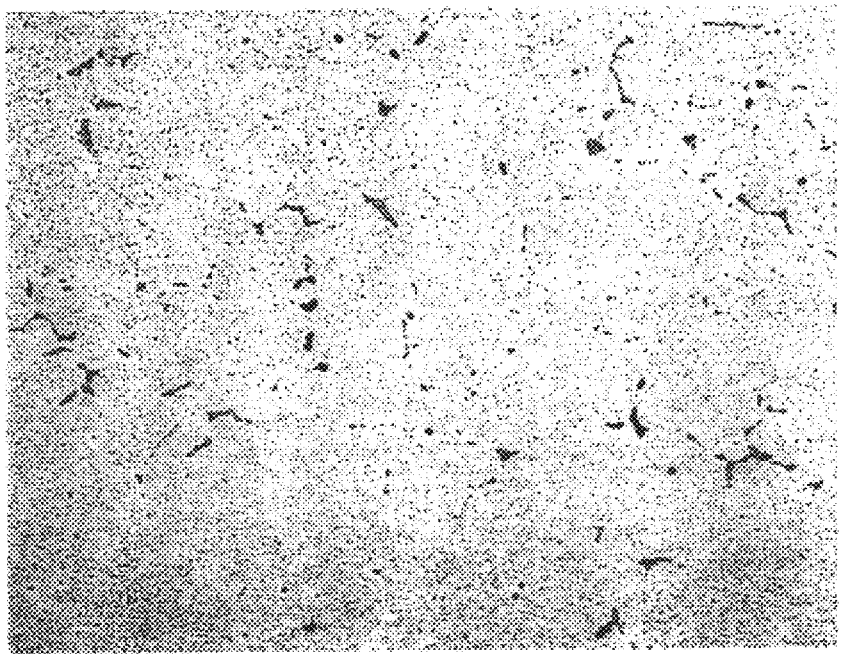
FIG. 9 is photomicrograph showing the microstructure of billet annealed for 2 hours at 775° F. at 400× magnification.
Figure 10:
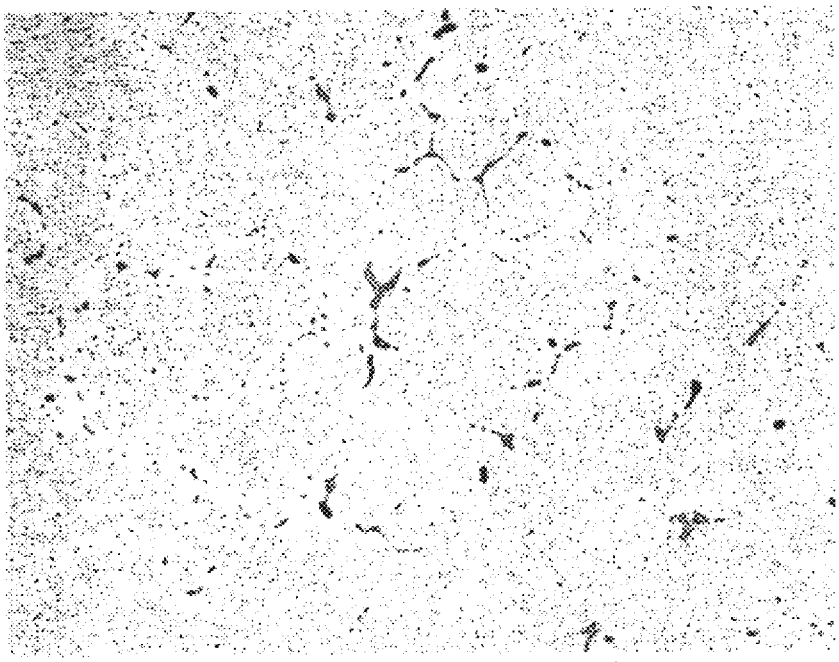
FIG. 10 is photomicrograph showing the microstructure of billet annealed for 2 hours at 820° F. at 400× magnification.

The microstructure of the materials of the present invention were studied. The microstructures were "frozen" by water quenching the billet after the reheat/anneal. The microstructures of material heated to 700° F., 775° F. and 820° F. are shown in FIGS. 8–10.

Figure 7:
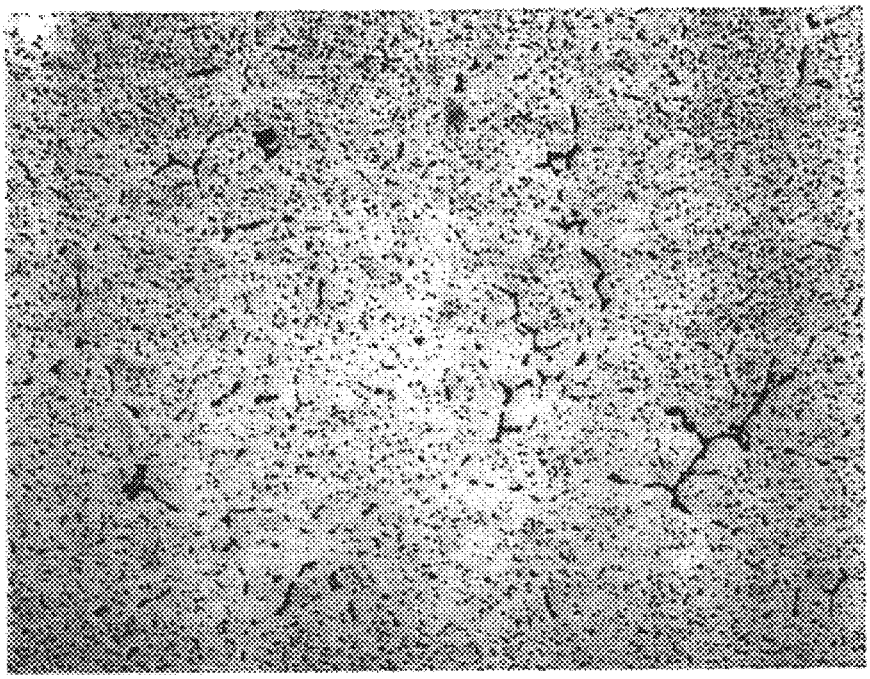
FIG. 7 is photomicrograph showing the microstructure of standard preheated billet at 400× magnification.

Without wishing to be bound by any theory, it is believed that the influence of annealing the billet has a significant impact on precipitate size and distribution. With increasing anneal temperature the precipitate size becomes significantly smaller. In fact, annealing at 775° F. and 820° F. results in precipitates which are more than an order of magnitude smaller than the standard preheated billet of FIG. 7. Based on the difference in billet microstructure shown in these Figures, it is suspected that the finer precipitate structure found in the 775° F. and 820° F. annealed billet is capable of being dissolved in the deformation zone. With the dissolution of the precipitates, the potential for hot tearing due to a low temperature eutectic melting reaction is eliminated.

It is believed that the 700° F. anneal provides a precipitate which is of a size that cannot be consistently dissolved. It is worth noting, however, that for the standard billet and as the 700° F. anneal billet conditions that if the speed is further increased and the temperature is further increased in the deformation zone that the tearing gradually disappears despite have an even higher exit temperature. It is believed that dissolution of the precipitates is occurring in the deformation zone. However, the precipitate size and distribution is critical in achieving an initial extrusion process which can initially achieve the higher exit temperatures without tearing.

It is to be appreciated that certain features of the present invention may be changed without departing from the present invention. Thus, for example, it is to be appreciated that although the invention has been described in terms of a preferred embodiment for extruding hard aluminum alloys, it will be apparent to those skilled in the art that the present invention will also be valuable in the fabrication of other metals. Metals suitable for use with the present invention are not limited to aluminum and aluminum alloys. Objects formed from other metals such as magnesium, copper, iron, zinc, nickel, cobalt, titanium, and alloys thereof may also benefit from the present invention.

Whereas the preferred embodiments of the present invention have been described above in terms of extruding hard aluminum alloys, it will be apparent to those skilled in the art that the method of forming the metal objects is not considered critical to its usefulness. It is contemplated also that the method and apparatus of the present invention will also be valuable in increasing the productivity of other forming processes including rolling and stamping. In addition, whereas the invention has been described in terms of direct extrusion process, the invention can also be used in indirect extrusion.

Whereas the preferred embodiments of the present invention have been described above in terms of being especially valuable in producing AA7075 aluminum alloy extrusions, it will be apparent to those skilled in the art that the present invention will also be valuable in producing extrusions made of other aluminum alloys containing about 80% or more by weight of aluminum and one or more alloying elements. Among such suitable alloying elements is at least one element selected from the group of essentially character forming alloying elements and consisting of manganese, zinc, beryllium, lithium, copper, silicon and magnesium. These alloying elements are termed as essentially character forming for the reason that the contemplated alloys containing one or more of them essentially derive their characteristic properties from such elements. Usually, the amounts of each of the elements which impart such characteristics are, as to each of magnesium and copper, about 0.5 to about 10 wt. % of the total alloy if the element is present as an alloying element in the alloy; as to the element zinc, about 0.05 to about 12.0% of the total alloy if such element is present as an alloying element; as to the element beryllium, about 0.001 to about 5.0% of the total alloy if such element is present as an alloying element; as to the element lithium, about 0.2 to about 3.0% of the total alloy if such element is present as an alloying element; and as to the element manganese, if it is present as an alloying element, usually about 0.15 to about 2.0% of the total alloy.

The elements iron and silicon, while perhaps not entirely or always accurately classifiable as essentially character forming alloy elements, are often present in aluminum alloy in appreciable quantities and can have a marked effect upon the derived characteristic properties of certain alloys containing the same. Iron, for example, which if often present and considered as an undesired impurity, is oftentimes desirably present and adjusted in amounts of about 0.3 to 2.0 wt. % of the total alloy to perform specific functions. Silicon may also be so considered, and while found in a range varying from about 0.25 to as much as 15%, is more often desirably found in the range of about 0.3 to 1.5% to perform specific functions. In light of the foregoing dual nature of these elements and for convenience of definition, the elements iron and silicon may, at least when desirably present in character affecting amounts in certain alloys, be properly also considered as character forming alloying ingredients.

Such aluminum and aluminum alloys, which may contain one or more of these essential character forming elements, may contain, either with or without the aforementioned character forming elements, quantities of certain well known ancillary alloying elements for the purpose of enhancing particular properties. Such ancillary elements are usually chromium, nickel, zirconium, vanadium, titanium, boron, lead, cadmium, bismuth, and occasionally silicon and iron. Also, while lithium is listed above an essential character forming element, it may in some instances occur in an alloy as an ancillary element in an amount within the range outlined above. When one of these ancillary elements is present in the aluminum alloy of the type herein contemplated, the amount, in terms of percent by weight of the total alloy, varies with the element in question but is usually about 0.05 to 0.4%, titanium about 0.01 to 0.25%, vanadium or zirconium about 0.05 to 0.25%, boron about 0.0002 to 0.04%, cadmium about 0.05 to 0.5%, and bismuth or lead about 0.4 to 0.7%.

What is believed to be the best mode of the invention has been described above. However, it will be apparent to those skilled in the art that these and other changes of the type described could be made to the present invention without departing from the spirit of the invention. The scope of the present invention is indicated by the broad general meaning of the terms in which the claims are expressed.

Having described the presently preferred embodiments, it is to be understood that the invention may be otherwise embodied within the scope of the appended claims.

What is claimed is:

1. A method for extruding an aluminum base alloy extruded product, wherein the aluminum alloy is selected selected from the group consisting of Aluminum Association 2000 series, 5000 series, and 7000 series alloy, comprising:

(a) providing a body of an aluminum base alloy;

(b) homogenizing said body at an elevated temperature not exceeding its eutectic temperature for a sufficient period of time to provide a homogeneous distribution of the readily soluble alloy elements, (c) rapidly cooling said body;

(d) reheating said body to a reheat temperature of at least 700° F. for a period of at least 0.5 hours;

(e) extruding said body from said reheat temperature;

(f) solution heat treating the said body; and (g) quenching and aging said body.

2. The method of claim 1 in which (b) includes:

homogenizing said body at an elevated temperature not exceeding its eutectic temperature of about 900° F.

3. The method of claim 1 in which (b) includes:

homogenizing said body at an elevated temperature greater than about 850° F.

4. The method of claim 1 in which (c) includes:

rapidly cooling said body to about room temperature or below.

5. The method of claim 1 in which (c) includes:

rapidly cooling said body at a rate of at least about 200° F. per hour.

6. The method of claim 1 in which (c) includes:

rapidly cooling said body at a rate between about 200° F. per hour and about 1,000° F.

7. The method of claim 1 in which (c) includes:

rapidly cooling said body at a rate between about 300° F. per hour and about 600° F.

8. The method of claim 1 in which (c) includes:

rapidly cooling said body using forced air cooling.

9. The method of claim 1 in which (c) includes:

rapidly cooling said body using water cooling.

10. The method of claim 1 in which (c) includes:

rapidly cooling said body using mist cooling.

11. The method of claim 1 in which (d) includes:

reheating said body to a reheat temperature between about 700° F. to about 900° F.

12. The method of claim 1 in which (d) includes:

reheating said body to a reheat temperature of at least about 700° F. for a period of at least about 0.5 to about 6 hours.

13. The method of claim 1 in which (d) includes:

reheating said body to a reheat temperature by induction heating of said body.

14. The method of claim 1 in which (d) includes:

reheating said body to a reheat temperature by gas fired heating of said body.

15. The method of claim 1 in which (e) includes:

extruding said body so that the exits temperature of said body is in the range of about 780° to about 950° F.

16. The method of claim 1 which further includes:

cold working said body after said solution heat treatment.

17. The method of claim 1 which further includes:

drawing said body after said solution heat treatment.

18. The method of claim 1 which further includes:

cold working said body by drawing to a reduction in cross section of over 3%.

19. The method of claim 1 which further includes:

cold working said body by drawing and then artificially aging said body.

20. The method of claim 1 which further includes:

imparting a cold working effect substantially equivalent to stretching at least 1% at room temperature.

21. The method of claim 1 which further includes:

imparting a cold working effect substantially equivalent to stretching at least 3% at room temperature.

22. The method of claim 1 which further includes:

imparting a cold working effect substantially equivalent to stretching to less than about 10% at room temperature.

23. A method for extruding an aluminum base alloy extruded product, wherein the aluminum alloy is selected selected from the group consisting of Aluminum Association 2000 series, 5000 series, and 7000 series alloy, comprising:

(a) providing a body of an aluminum base alloy;

(b) homogenizing said body at an elevated temperature not exceeding its eutectic temperature for a sufficient period of time to provide a homogeneous distribution of the readily soluble alloy elements, (c) rapidly cooling said body to a reheat temperature of about 700° to about 860° F.;

(d) maintaining said body at said reheat temperature for at least 0.5 hours;

(e) extruding said body from said reheat temperature;

(f) solution heat treating the said body; and (g) quenching and aging said body.

24. A method for extruding an aluminum base alloy extruded product, wherein the aluminum alloy is selected selected from the group consisting of Aluminum Association 2000 series, 5000 series, and 7000 series alloys, comprising:

(a) providing a body of an aluminum base alloy;

(b) homogenizing said body at an elevated temperature not exceeding its eutectic temperature for a sufficient period of time to provide a homogeneous distribution of the readily soluble alloy elements, (c) slow cooling said body to substantially room temperature;

(d) heat said body to an annealing temperature of about 700° to about 880° F.;

(e) maintaining said body at said annealing temperature for at least 0.5 hours;

(f) rapidly cooling said body;

(g) reheating said body to a preheat temperature of at least 700° F. for a period of at least 0.5 hours;

(h) extruding said body from said preheat temperature;

(i) solution heat treating the said body; and (j) quenching and aging said body.

25. The method of claim 24, wherein said slow cooling of (c) is less than about 100° F. per hour.

26. A method for extruding an aluminum base alloy extruded product, wherein the aluminum alloy is selected selected from the group consisting of Aluminum Association 2000 series, 5000 series, and 7000 series alloys, comprising:

(a) providing a body of an aluminum base alloy;

(b) homogenizing said body at an elevated temperature not exceeding its eutectic temperature for a sufficient period of time to provide a homogeneous distribution of the readily soluble alloy elements, (c) rapidly cooling said body to an annealing temperature of about 700° to about 860° F;

(d) maintaining said body at said annealing temperature for at least 0.5 hours;

(e) rapidly cooling said body;

(f) reheating said body to a preheat temperature of at least 700° F. for a period of at least 0.5 hours;

(g) extruding said body from said preheat temperature;

(h) solution heat treating the said body; and (i) quenching and aging said body.

* * * * *